US006976744B2

(12) United States Patent
Hay et al.

(10) Patent No.: US 6,976,744 B2
(45) Date of Patent: Dec. 20, 2005

(54) TOOL STORAGE PROJECT CENTER WITH POWER STRIP

(75) Inventors: Michael E. Hay, Dysart, IA (US); Ramon L. Klemmensen, Cedar Falls, IA (US); Fred P. Ritchie, Cedar Falls, IA (US); Steven F. Kohagen, Waverly, IA (US)

(73) Assignee: Waterloo Industries, Inc., Waterloo, IA (US)

( * ) Notice: Subject to any disclaimer, the term of this patent is extended or adjusted under 35 U.S.C. 154(b) by 155 days.

(21) Appl. No.: 10/429,606

(22) Filed: May 5, 2003

(65) Prior Publication Data

US 2004/0160150 A1 Aug. 19, 2004

Related U.S. Application Data

(63) Continuation-in-part of application No. 29/175,913, filed on Feb. 13, 2003, now Pat. No. Des. 489,859.

(51) Int. Cl.[7] ..... A47B 81/00
(52) U.S. Cl. ..... 312/281; 312/249.13

(58) Field of Search ..... 312/280, 281, 312/283, 290, 249.1, 249.8, 249.13

(56) References Cited

U.S. PATENT DOCUMENTS

| | | | | |
|---|---|---|---|---|
| 3,708,709 | A * | 1/1973 | Morrison et al. | 312/209 |
| 4,720,048 | A * | 1/1988 | Maroney et al. | 280/47.34 |
| 4,790,610 | A * | 12/1988 | Welch et al. | 312/218 |
| 5,016,948 | A * | 5/1991 | Welch et al. | 312/249.12 |
| 5,244,265 | A * | 9/1993 | Chiang | 312/107 |
| 5,702,115 | A * | 12/1997 | Pool | 280/47.35 |
| 5,857,757 | A * | 1/1999 | Bieker et al. | 312/351.3 |

* cited by examiner

*Primary Examiner*—James O. Hansen
(74) *Attorney, Agent, or Firm*—Calfee, Halter & Griswold, LLP

(57) ABSTRACT

A combination storage cabinet and work bench comprises a rectangular parallelepiped sheet metal cabinet with multiple slidable drawers accessible from the front side of the cabinet, polymeric molded lateral side modules which serve as handles and which include storage shelves for power tools and accessories and a top cover for the cabinet which includes interchangeable multiple work surface elements.

20 Claims, 6 Drawing Sheets

51
53
55
57
55
100
96
98
40
64
94
92
88
82
86
90
84
80
46
46
10
46

FIG. 2
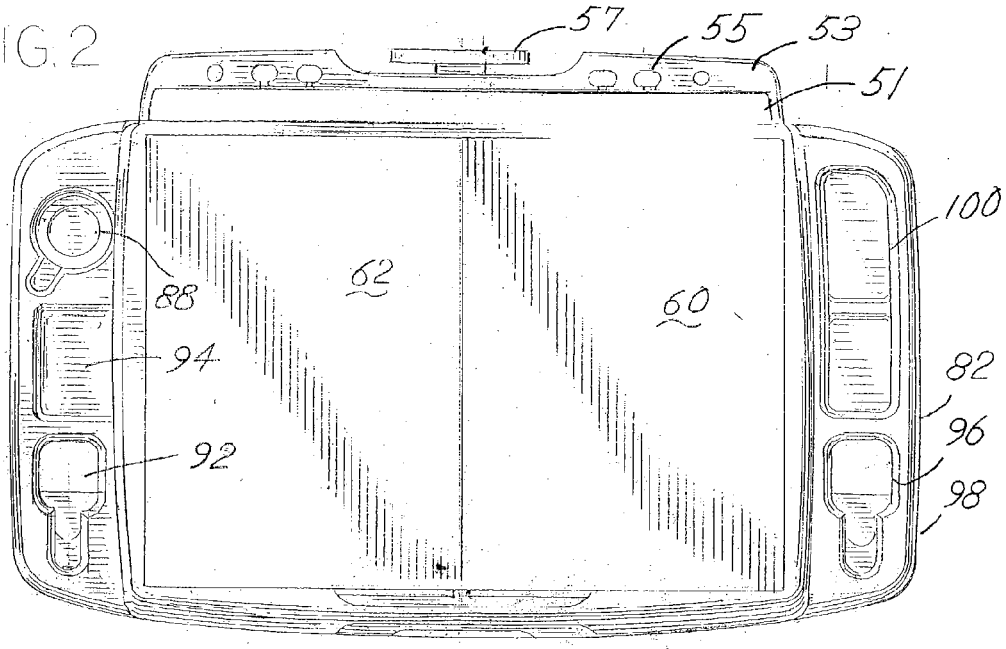
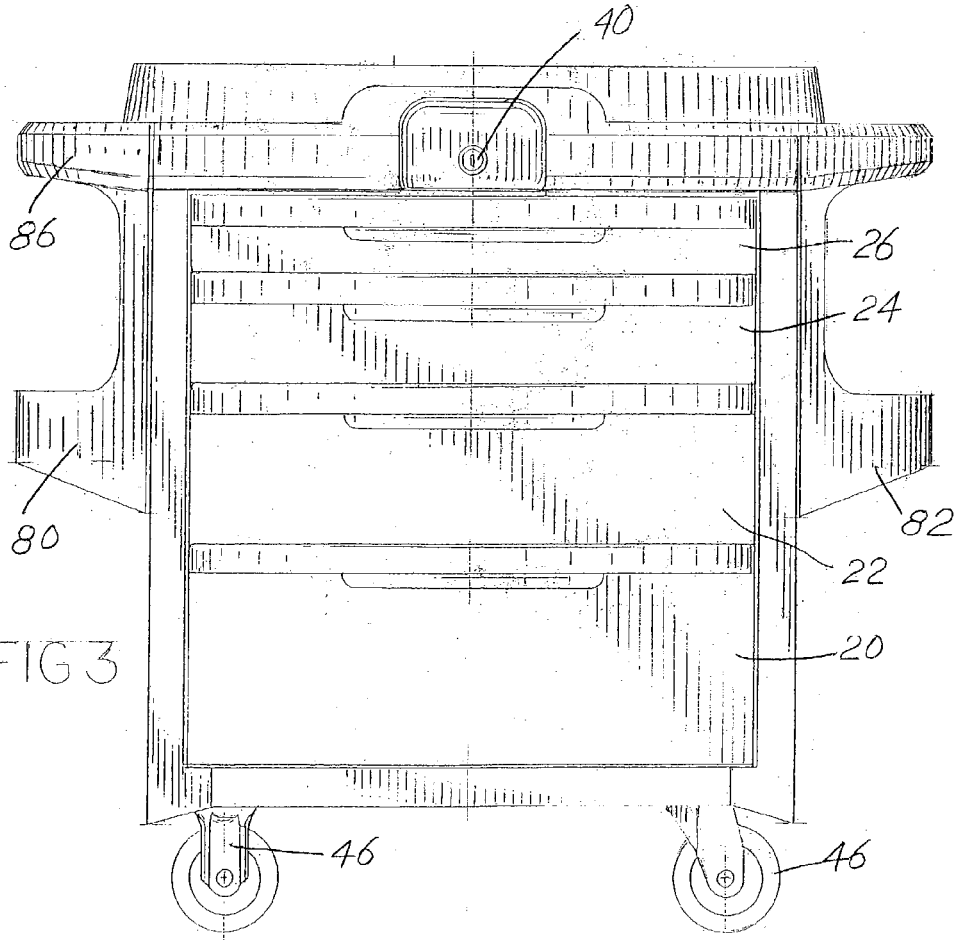
FIG 3

TOOL STORAGE PROJECT CENTER WITH POWER STRIP

CROSS REFERENCE TO RELATED APPLICATION

This is a continuation-in-part of design application of Ser. No. 29/175,913 filed Feb. 13, 2003, now U.S. Pat. No. D, 489,858 which is incorporated herewith by reference and for which priority is claimed.

BACKGROUND OF THE INVENTION

In a principal aspect the present invention relates to a tool storage cabinet and work bench combination which incorporates drawers for storage of tools and other items as well as brackets, shelves, storage bins and alternative work bench work surfaces.

Mechanics, carpenters, tradesmen and hobbyists use tool chests, storage cabinets and other means to store their various tools and to facilitate the performance of their hobby or work. Many work benches and storage cabinets include a top surface or tabletop which enables the performance of operations on the cabinet which also includes drawers and shelves for tool and parts storage. Further, storage cabinets have heretofore been mounted on casters or rollers to facilitate their movement in the workspace. Mechanics, in particular, utilize rolling tool storage cabinets and work benches.

Nonetheless, there has remained the desire and need for work benches and storage cabinets of the type mounted on casters and capable of facilitating the performance of multiple tasks. Further, a desire with respect to such a tool storage cabinet and work bench is to incorporate a means for the storage and operation of power tools and, in particular, electric power tools.

These and other objectives led to the development of the combination storage cabinet and work bench of the invention.

SUMMARY OF THE INVENTION

Briefly, the present invention of a combination storage cabinet and work bench comprises a multiple drawer generally rectangular parallelepiped shaped sheet metal cabinet with a molded polymeric top assembly or cover which is fastened to the top of the cabinet and which is adapted to support multiple, separate cover plates that form a top work surface. The cover plates are reversible and moveable to enable exposure of the various sides of the plates having various surface treatments that may be desired for the performance of various and distinct tasks. The cabinet further includes molded polymeric modules affixed or attached to the opposite lateral sides thereof for the support of and storage of power tools, for the inclusion of electrical power sources and items such as chargers, and electrical outlets, and which also serve as handles for moving the cabinet. The cabinet is mounted on roller casters. The molded polymeric top includes recessed compartments for storage of various tools and items such as nuts, bolts, nails and the like.

Thus it is an object of the invention to provide an improved storage cabinet and work bench combination.

It is a further object of the invention to provide an improved storage cabinet and work bench which includes a molded polymeric top assembly capable of and designed to receive work surface platforms or plates that are reversible to expose various work surface treatments.

Yet a third object of the invention is to provide an improved storage cabinet and work bench which incorporates modules attached to the lateral sides of the workbench for the purpose of storage of items including power tools and electrical connections and chargers associated with such power tools.

A further object of the invention is to provide a storage cabinet and work bench which is structurally rugged, easy to use, easy to move inasmuch as the cabinet is mobile, and which enables storage of power tools and other tools in an accessible manner that will not interfere with the utilization of the work bench top work surface, yet which provides easy access to such tools.

Another object of the invention is to provide a work bench and tool storage cabinet mounted on casters and having lateral side tool storage modules which also serve as handles to facilitate movement of the cabinet.

These and other objects, advantages, and features of the invention will be set forth in the detailed description which follows.

BRIEF DESCRIPTION OF THE DRAWING

In the detailed description which follows, reference will be made to the drawing comprised of the following figures:

FIG. 2 is a top plan view of the storage cabinet and work bench of FIG. 1;

FIG. 3 is a front view of the cabinet of FIG. 1;

DESCRIPTION OF THE PREFERRED EMBODIMENT

Figure 1:
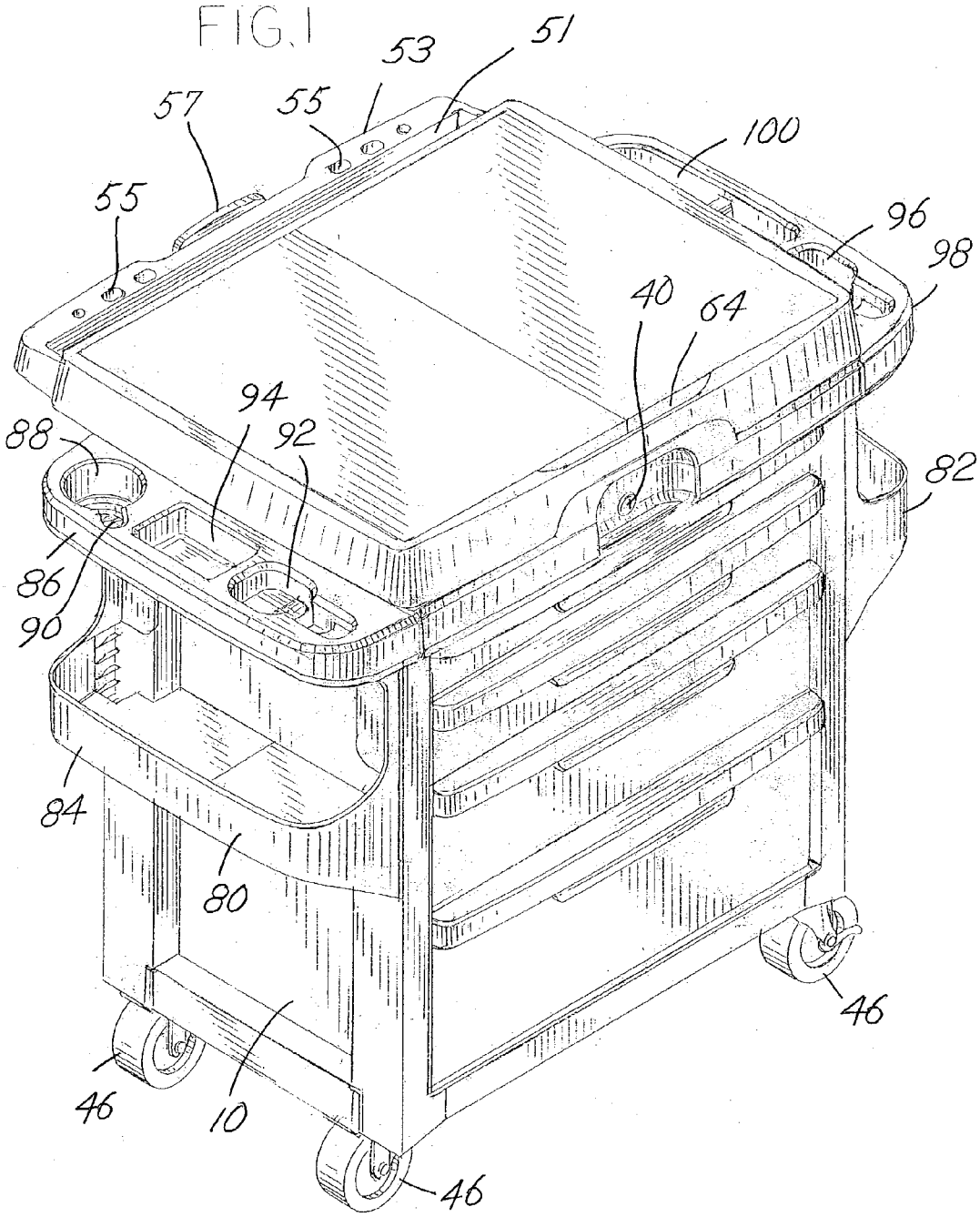
FIG. 1 is an isometric view of the combination storage cabinet and work bench of the invention.
Figure 4:
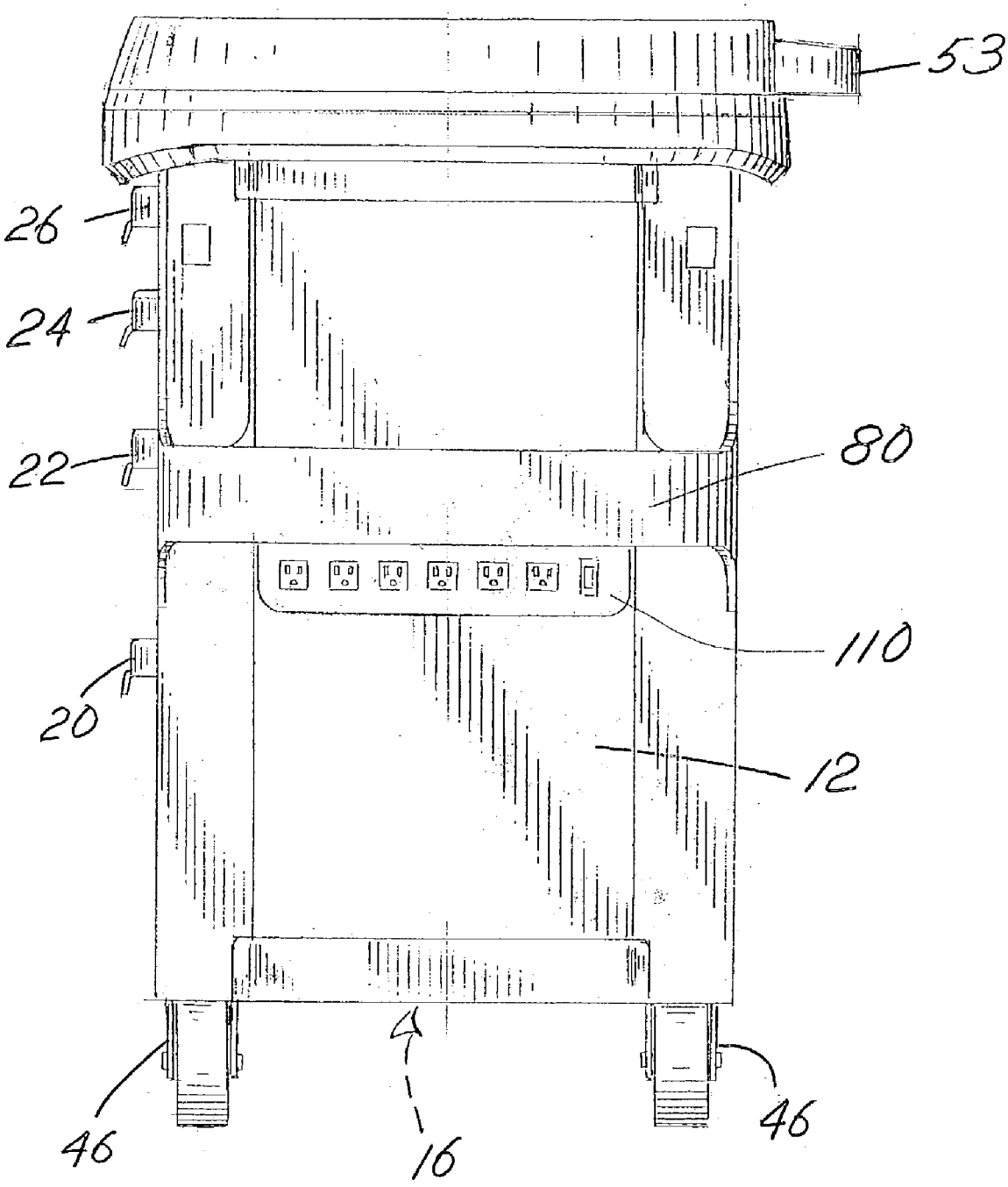
FIG. 4 is a side elevation as viewed from the right side of the storage cabinet in FIG. 3.
Figure 5:
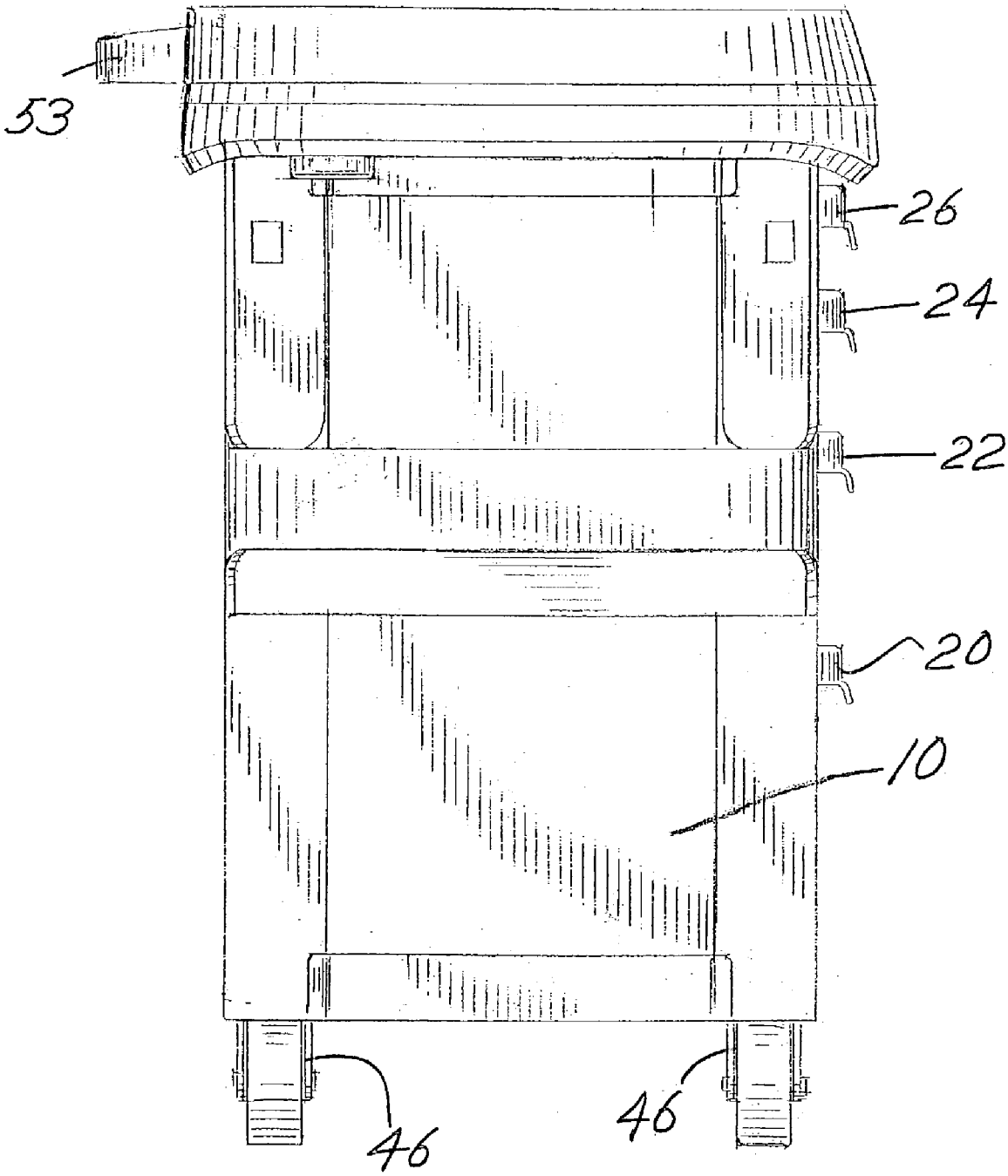
FIG. 5 is a left side elevation of the storage cabinet of FIG. 3.
Figure 6:
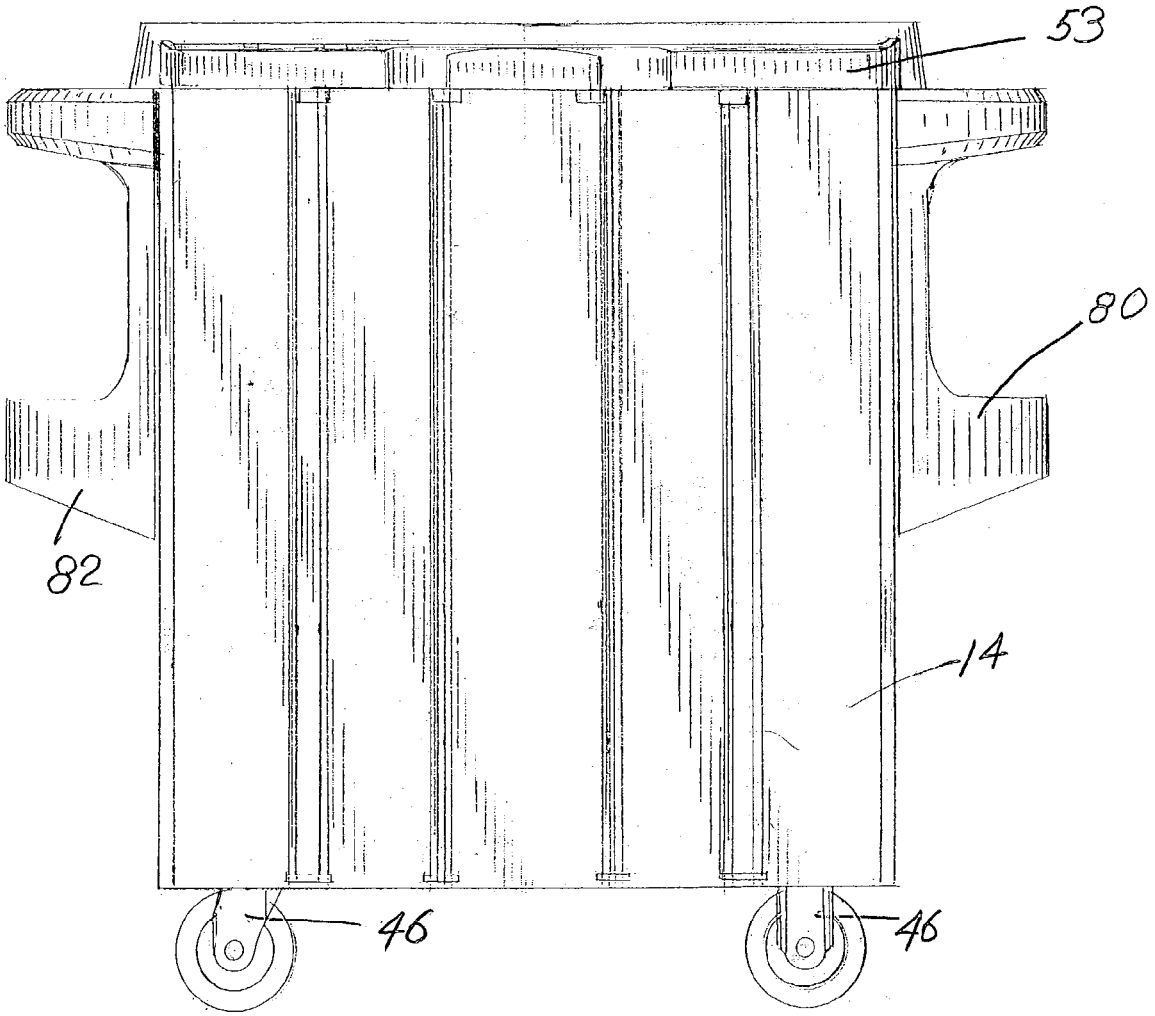
FIG. 6 is a rear elevation of the storage cabinet of FIG. 3.

Referring to the figures, the storage cabinet and work bench is comprised of a rectangular, parallelepiped sheet metal cabinet which includes a first lateral side wall 10, a second lateral side wall 12, a back side wall 14 and a bottom panel 16, as well as a top planar panel 18. The formed metal sides 10, 12, 14, 16, 18 are welded together or alternatively held together by fasteners to form the rectangular parallelepiped cabinet enclosure with an open front into which multiple drawers, such as drawers 20, 22, 24, 26 are positioned on slides such as slide 28. The drawers 20, 22, 24, 26 are mounted on the slide channels 28 so as to move into and out of the front opening defined in the parallelepiped cabinet.

Each of the drawers 20, 22, 24, 26 includes a front handle or fascia 30 which is snap-fitted into the front panel such as panel 32 of each of the drawers. The handle 30 is a molded polymeric handle and includes projecting rear tabs which fit through slots defined in the front panel 32 to retain the handle.

The drawers 20, 22, 24, 26 are also interlocked and may be locked in a closed position simultaneously. Thus, a channel 34 retained by a bracket 36 on the inside panel 12 or back panel 14 of the cabinet may be actuated by means of a rod 38 in response to a cylinder lock 40 mounted on the cabinet to lock all of the drawers 20, 22, 24, 26 in a closed position. That is, rotation of the rod 38 by means of lock 40 will move the channel 34 upwardly or downwardly in order to effect a locking or holding of the drawers in a closed position by engagement of the channel 34 with projecting tabs 42 extending from the back side of drawers such as drawer 20. In any event, the locking mechanism and drawer mounting mechanism for the drawers 20, 22, 24, 26 is generally conventional. It is the combination of elements forming the storage cabinet and work bench which is considered to be new and novel.

The component parts so far described comprising the walls of the rectangular parallelepiped cabinet and the drawers are generally formed from sheet metal which is stamped and welded. The basic cabinet is mounted on rollers or casters such as casters 46. The casters 46 may be swivel casters and may further include a locking feature to retain the cabinet in a fixed position. Generally, two of the four casters 46 on the cabinet are swivel type casters 46 and include a brake, whereas the remaining two casters 46 are rigid and may not swivel. For example, the casters 46 on the right hand side of the cabinet as depicted in FIG. 1 are swivel casters 46 with a brake, whereas the casters 46 on the left hand side of the figure in FIG. 1 are rigid casters 46.

The work cabinet further includes a molded polymeric top assembly 50. As depicted in the figures, the molded polymeric top assembly 50 includes a multiple series of recessed compartments such as compartment 52 and 54. Importantly, the top assembly 50 includes a peripheral ledge 56 with a surrounding peripheral upwardly extending lip or flange 58 which, in the preferred embodiment, is generally rectangular in shape and configuration. Thus, a first work surface element 60 and a second work surface element 62 may be fitted into the top of the cover 50. Being so fitted into the top of the cover 50 as, for example, as illustrated in FIG. 1, a work surface is provided which may be used for performance of various work bench operations.

Importantly, there is a center recess or handhold 64 in the lip 58 which enables a worker to insert their fingers into the handhold 64 to engage and move the work surface elements 60 and 62. This becomes important inasmuch as the elements 60 and 62 employ different types of work surfaces. For example, the element 60 may have a polymeric coating on one side and a metal plate on the opposite side. The work surface element 62 may include a wooden surface on one side and a distinct type of composite material surface on the opposite side. Various permutations and combinations of surface treatments may thus be incorporated into the elements 60 and 62 thereby expanding the utility of the work bench for numerous purposes. Such adjustment is effected by virtue of the availability of the handhold 64.

The top cover 50 is molded to include a longitudinal channel 51. The longitudinal channel 51 provides a place for storage of a carpenter's level, for example. The longitudinal channel 51 is framed by a molded plastic section or outside element 53 which includes various openings, such as opening 55 for receipt of tools such as screwdrivers and the like. The longitudinal element 53 further includes an electric cord support flange 57 molded integrally with the element 53. It should be noted that the level recess or tray section 51 is positioned in a manner whereby an item stored therein will remain below the horizontal upper ledge or edge of the cover 50 so that the planar work surface defined by the elements 50 and 52 will not interfere with an item stored in the tray 51.

Figure 7:
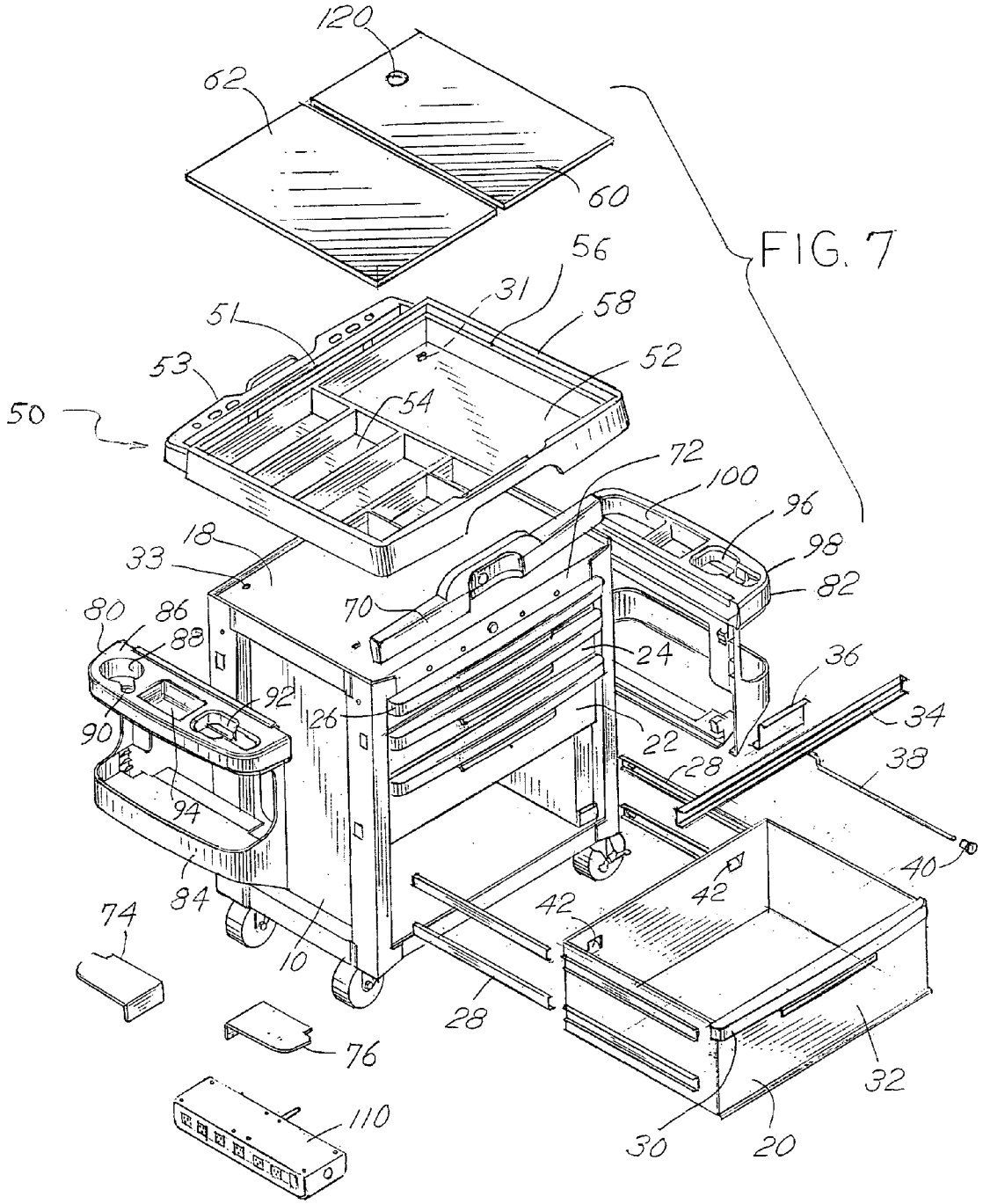
FIG. 7 is an exploded isometric view of the storage cabinet of FIG. 1 illustrating the component parts thereof.

The work cabinet further includes a fascia member 70 which is a molded polymeric element affixed to the top edge of the cabinet 72 in FIG. 7 by being snap-fitted in a manner similar to the snap-fit attachment of the handles such as handle 30. The top assembly 50 is also attached to the top panel 18 of the cabinet by means of projecting integrally molded tabs 31 fitted into slots 33 in the top panel 18. Attachment may be augmented by fasteners such as screws, bolts or the like.

The storage cabinet includes a left side molded polymeric storage module 80 and a right side module 82. Each of the modules 80 and 82 is attached, preferably by snap-fit tabs, to the lateral sides 10 and 12 respectively of the cabinet. The construction of the modules 80, 82 is customized to provide for various functionality including storage of tools and accessories, mounting for a power strip and chargers, and as handles for cabinet movement. For example, the left hand storage module 80 includes a molded shelf 84 into which support channels 74 and 76 may be optionally inserted to support an element such as a battery charger or the like. Further, the left hand storage module includes an upper tray 86 with the recess 88 including a passage 90 molded in a form which will receive and hold a power tool in holster-like fashion. A second recess 92 is provided in the top of an upper shelf 86. A storage compartment 94 for fasteners or the like is also included in the upper shelf 86.

The right hand module 82 has a similar construction and includes a collar 96 with a passage in an upper shelf 98 for holding a power tool. Storage compartments such as storage compartment 100 are also provided.

The modules such as the left module 80 further include an electric power strip 110 which may be attached to the lower side or lower shelf 84 of the module. In this manner, electric power may be provided easily to the various tools retained in the storage cabinet.

It is to be noted that the shelves 84 and 86, particularly the shelf 86 of the modules, such as module 80, comprise handles which enable or facilitate movement of the work bench and cabinet combination. Thus, one may grasp or grip the upper shelf 86 to effect movement of the cabinet or casters 46.

The work surface elements 60 and 62 may include a pattern of openings or a set of openings, for example opening 120, which facilitate attachment of various tool elements. For example, a vice tool 124 may be incorporated with or attached to work surface element 60. The vice tool is comprised of an "L" shaped arm with a first end for attachment to the cover plate 60 and the second end with a threaded vertical opening for receiving a vertically mounted threaded rod 125. The threaded rod may then be rotated in the vertical opening to provide a clamping member. Various other tools and elements may be incorporated into the top work surface elements 60 and/or 62.

The subject matter of the invention may be modified in various ways while still being within the scope of the invention. For example, two work surface elements 60 and 62 were disclosed. Multiple work surface elements may be utilized as may a single element. The work surface elements may include tools attached thereto so that the work surface element and tool can be positioned on the cover 50 with the tools incorporated therewith. A single work surface element may be substituted for the two elements 60 and 62. The flange 58 which retains the work surface elements 60, 62 in position may be altered in its configuration and construction. The handhold 64 for access to the work surface elements 60, 62 may also be modified and positioned in any of the number of places. The trays incorporated into the cover 50 may be varied in number, size and position. The construction of the side modules, e.g. 80, may also be modified. A single module may be incorporated with the work cabinet or multiple modules. The modules are designed to include "holsters" for the retention of power tools. Further, the modules have the dual purpose of providing a handle or means for ease of movement of the work cabinet.

Thus, while there have been set forth various alternatives and features of the invention and the preferred embodiment has been described, it is to be understood that the invention is to be limited only by the following claims and equivalents thereof.

What is claimed is:

1. A combination storage cabinet and workbench comprising in combination:

a multiple drawer, generally rectangular parallelepiped shaped cabinet having a front side, a first lateral side, a second opposite lateral side, a back side, a bottom side, and a top side;

a molded polymeric cabinet top cover sized and shaped generally congruent with and fitted onto said top side, said top cover including first and second recessed storage tray section;

a first removable cover plate fitted over the first storage tray section; and a second removable cover plate fitted over the second tray section, said cover plates in combination comprising a unitary, flat planar work surface for said workbench;

wherein the top cover further includes a third tray section extending transversely between the first lateral side and the second lateral side, said third tray section recessed relative to the cover plates whereby an item stored in the third tray section is maintained below the plane of the cover plates;

further wherein the third tray section is comprised of circumferential wall section surrounding a recessed support panel, said circumferential wall section including an outside run spaced from the plane of the backside, said outside run including an integral molded hook member for support of an item.

2. The combination of claim 1 wherein the cabinet is formed from a sheet metal material and includes at least two spaced openings along the top side, and wherein the cabinet top includes at least two integrally molded, elastically deformable, polymeric tab elements, each tab element insertable into a separate one of the spaced openings to retain the top cover attached to the cabinet.

3. The combination of claim 1 wherein the top and bottom side of at least one cover plate includes a different surface configuration.

4. The combination of claim 3 wherein at least one of said cover plates includes a surface material selected from the group consisting of a polymeric, metal, wood and a composite material.

5. The combination of claim 1 wherein at least one recessed storage tray includes dividing walls.

6. The combination of claim 1 including a first molded polymeric storage subassembly;

said first subassembly comprising a generally vertical side panel mounted on one of said lateral sides of said cabinet, said side panel including an upper tray and a lower tray, said side panel further including a tool support collar with a passage for receipt of a tool oriented for manual insertion, retention and manual removal of said tool.

7. The combination of claim 6 further including a power strip attached to the side panel.

8. The combination of claim 6 wherein the lower tray comprises a tray wall surrounding a generally flat, planar tray bottom, with an inside and an outside surface, said tray extending between the front side and backside of the cabinet, and including a power strip housing integrally molded to the outside of the bottom of said tray and maintained within the profile of the tray wall.

9. The combination of claim 8 further including at least one removable support shelf for placement within the tray supported by the bottom and retained by the tray wall, whereby the support shelf will effect elevated support of an item in the tray.

10. The combination of claim 6 wherein at least one of said lateral sides is formed from sheet metal and includes at least two vertical panel support openings, and said generally vertical panel includes a support tab member fitted into said lateral side support openings for maintaining the vertical panel attached to the cabinet.

11. The combination of claim 1 wherein the molded top cover includes a generally flat planar circumferential rim surrounding the tray sections, and further including a peripheral land recessed below the rim for support of the cover plates.

12. The combination of claim 1 wherein at least one of the cover plates includes at least one perforation for cooperation with a work tool.

13. The combination of claim 1 further including at least one drawer mounted for sliding into and out of the front side of the cabinet, said drawer and cabinet formed from sheet metal, said drawer including a front drawer panel; and a molded polymeric handle for said sliding drawer front panel, said handle and front panel including a fastener assembly for snap-fitting said handle to the front panel.

14. A combination storage cabinet and workbench comprising in combination:

a multiple drawer, generally rectangular parallelepiped shaped cabinet having a front side, a first lateral side, a second opposite lateral side, a back side, a bottom side, and a top side;

a molded polymeric cabinet top cover sized and shaped generally congruent with and fitted onto said top side, said top cover including first and second recessed storage tray section;

a first removable cover plate fitted over the first storage tray section; and a second removable cover plate fitted over the second tray section, said cover plates in combination comprising a unitary, flat planar work surface for said workbench;

wherein the cabinet is formed from a sheet metal material and includes at least two spaced openings along the top side, and wherein the cabinet top includes at least two integrally molded, elastically deformable, polymeric tab elements, each tab element insertable into a separate one of the spaced openings to retain the top cover attached to the cabinet.

15. The combination of claim 14 wherein the top and bottom side of at least one cover plate includes a different surface configuration.

16. The combination of claim 14 wherein at least one recessed storage tray includes dividing walls.

17. The combination of claim 14 including a first molded polymeric storage subassembly comprising a generally vertical side panel mounted on one of said lateral sides of said cabinet, said side panel including an upper tray and a lower tray, said side panel further including a tool support collar with a passage for receipt of a tool oriented for manual insertion, retention and manual removal of said tool.

18. The combination of claim 14 wherein the molded top cover includes a generally flat planar circumferential rim surrounding the tray sections, and further including a peripheral land recessed below the rim for support of the cover plates.

19. The combination of claim 14 wherein at least one of the cover plates includes at least one perforation for cooperation with a work tool.

20. The combination of claim 14 further including at least one drawer mounted for sliding into and out of the front side of the cabinet, said drawer and cabinet formed from sheet metal, said drawer including a front drawer panel; and a molded polymeric handle for said sliding drawer front panel, said handle and front panel including a fastener assembly for snap-fitting said handle to the front panel.

* * * * *